US005885720A

United States Patent [19]

Fujiwara et al.

[11] Patent Number: 5,885,720

[45] Date of Patent: Mar. 23, 1999

[54] PAPER COATING AGENT

[75] Inventors: Naoki Fujiwara; Sadahiko Shiraga; Kazuhiko Ootake; Toshiaki Sato, all of Kurashiki, Japan

[73] Assignee: Kuraray Co., Ltd., Kurashiki, Japan

[21] Appl. No.: 974,978

[22] Filed: Nov. 20, 1997

Related U.S. Application Data

[63] Continuation of Ser. No. 618,309, Mar. 18, 1996, abandoned.

[51] Int. Cl.[6] ..... B32B 23/08

[52] U.S. Cl. ..... 428/511; 525/61

[58] Field of Search ..... 524/503, 557; 525/60, 61; 428/511

[56] References Cited

U.S. PATENT DOCUMENTS

| | | | |
|---|---|---|---|
| 4,135,026 | 1/1979 | Hoyt | 525/61 |
| 4,611,029 | 9/1986 | Takahashi | 525/61 |
| 4,931,500 | 6/1990 | Okamoto | 525/61 |
| 5,134,036 | 7/1992 | Uemura | 525/60 |
| 5,260,371 | 11/1993 | Chen | 524/503 |
| 5,599,870 | 2/1997 | Nakamae | 524/503 |

FOREIGN PATENT DOCUMENTS

| | | |
|---|---|---|
| 0 692 494 | 1/1996 | European Pat. Off. . |
| 63 085 198 | 4/1988 | Japan . |
| 63-85198 | 4/1988 | Japan . |
| 63 112 794 | 5/1988 | Japan . |
| 63-112794 | 5/1988 | Japan . |
| 64 38279 | 2/1989 | Japan . |
| 06 064 330 | 3/1994 | Japan . |
| 6-64330 | 3/1994 | Japan . |

OTHER PUBLICATIONS

Database WPI, Derwent Publications, AN 89–088802, JP–A–01 038 279, Feb. 8, 1989.

*Primary Examiner*—Paul R. Michl

*Attorney, Agent, or Firm*—Oblon, Spivak, McClelland, Maier & Neustadt, P.C.

[57] ABSTRACT

Disclosed herein is a paper coating agent which comprises a modified polyvinyl alcohol (A) containing 3 to 15 mol % of ethylene units and an alkali metal ion (B), with the ratio of component (A) to component (B) being 100:0.003 to 100:1 in parts by weight. Disclosed also herein is a heat-sensitive recording material which comprises a coating layer on a substrate, said coating layer comprising a modified polyvinyl alcohol containing 3 to 15 mol % of ethylene units.

The paper coating agent of the present invention has such excellent solubility in boiling water that there is not a problem of insoluble matter in an aqueous solution of the coating agent. When applied for a paper surface coating agent, it gives coated paper without discoloration, superior, in surface strength, air barrier properties, and printability. When applied for a paper pigmented coating agent, it gives coated paper without discoloration, superior in water resistance and printability.

The heat-sensitive recording material of the present invention is superior in color developing sensitivity, water resistance, oil resistance, plasticizer resistance, and PVC film resistance. Furthermore it is superior in high-speed printability and image resolution, and it can be used in the field, such as facsimile, where high-speed printing is required.

15 Claims, No Drawings

PAPER COATING AGENT

This application is a Continuation of application Ser. No. 08/618,309, filed on Mar. 18, 1996, now abandoned.

BACKGROUND OF THE INVENTION

1. Field of the Invention

The present invention relates to a paper coating agent and also to a heat-sensitive recording material.

2. Description of the Prior Art

It has been common practice to use polyvinyl alcohol as a clear coating agent or pigmented coating agent to improve the surface properties of paper, such as surface strength, smoothness, gloss, gas barrier properties, water resistance, printability, and solvent resistance.

There has recently been a tendency for paper to decrease in surface strength because the percentage of waste-paper and South-Sea timber in the raw material for pulp is increasing. On the other hand, the increased printing speed requires the improvement of paper in surface strength. In the case of barrier paper, higher barrier properties are required. In the case of paper used for offset printing that uses water, high water-resistant strength is required.

In order to cope with these problems, there has been proposed a paper coating agent of modified polyvinyl alcohol containing 1 to 10 mol % of α-olefin units with 4 or less carbon atoms (Japanese Patent Application Laid-open Nos. 112794/1988 and 85198/1988). However, said modified polyvinyl alcohol has a problem of low solubility in water at 90° C. or more (hereinafter referred to as "boiling water"), and there has been a problem of insoluble matter in an aqueous solution of the coating agent.

The heat-sensitive recording material has come into general use as a recording medium for computers, word processors, telex, facsimiles, and calculators on account of its advantages of giving recorded images upon simple heating, requiring no complex processes for development and fixing, producing no noise at the time of recording, and giving recording systems at relatively small cost.

There is a demand for a heat-sensitive recording material capable of high-speed printing, as the printing speed of facsimiles etc. has been increasing every year. Also, there is a demand for a heat-sensitive recording material which has an excellent color developing sensitivity so that it can record images of not only characters but also drawings and photographs, accurately and neatly. Furthermore, there is a demand for a heat-sensitive recording material superior in water resistance, oil resistance, plasticizer resistance, and preservation stability.

A heat-sensitive recording materials comprises a substrate (such as paper, plastic film, or metal-deposited paper) and a heat-sensitive color developing layer applied thereon which develops a color by heat energy, on which a surface protective layer is usually applied.

The heat-sensitive color developing layer comprises a colorless or light-colored leuco dye (heat-sensitive dye), a color developing agent such as an organic acid or phenol compound which makes the leuco dye develop color upon heating, and a binder.

The binder which has been used in the heat-sensitive color developing layer is a water-soluble polymer such as polyvinyl alcohol, methyl cellulose, hydroxycellulose, polyvinylpyrrolidone, and oxidized starch. However, the heat-sensitive color developing layer obtained by the use of the conventional binder has a problem in color development sensitivity, water resistance, and preservation of images, although it is excellent in adhesion to the substrate.

The surface protective layer is made from polyvinyl alcohol, acrylamide-modified polyvinyl alcohol, acetoacetate-modified polyvinyl alcohol, or aldehydopolyacrylamide-styrene copolymer. However, the conventional surface protective layer has a problem in water resistance, oil resistance, and plasticizer resistance, which affect preservation stability.

There is sometimes applied an undercoating layer between the substrate and the heat-sensitive color developing layer, which is made from a water-soluble polymer such as polyvinyl alcohol and oxidized starch. However, the conventional undercoating layer has a problem of short life of the thermal head.

In order to cope with the above-mentioned problems, there have been proposed a heat-sensitive recording sheet comprising an overcoat layer of polyvinyl alcohol containing 1000 ppm or less of the content of sodium and a heat-sensitive recording sheet comprising a heat-sensitive color developing layer in which the binder comprises polyvinyl alcohol containing 1000 ppm or less of the content of sodium (Japanese Patent Application Laid-open No. 64330/1994). However, these conventional heat-sensitive recording sheets still have a problem in water resistance.

SUMMARY OF THE INVENTION

It is an object of the present invention to provide a paper coating agent which gives coated paper superior in surface strength, barrier properties (low absorption or low permeability of air, oil, and organic solvent), water resistance, and printability.

It is another object of the present invention to provide a heat-sensitive recording material with an excellent preservation stability of developed color, an invisible texture color of the substrate, and an excellent color developing sensitivity sufficiently adjustable to high-speed printing, and furthermore to provide a heat-sensitive recording material comprising a coating layer causing little wear of the thermal head.

As an intensive study to solve the above problems, the present inventors have found: a paper coating agent which comprises a modified polyvinyl alcohol (A) containing 3 to 15 mol % of ethylene units and an alkali metal ion (B), with the ratio of component (A) to component (B) being 100:0.003 to 100:1 in parts by weight (hereinafter referred to as "the first invention");

a heat-sensitive recording material which comprises a coating layer on a substrate, said coating layer comprising a modified polyvinyl alcohol containing 3 to 15 mol % of ethylene units (hereinafter referred to as "the second invention").

DETAILED DESCRIPTION OF THE PREFERRED EMBODIMENTS

First of all, the paper coating agent of the first invention is described in detail.

The content of ethylene units of a modified polyvinyl alcohol (hereinafter sometimes referred to as "PVA") (A) which is used in the first invention is 3 to 15 mol %, preferably .3 to 13 mol %, more preferably 3.5 to 12 mol %, and most preferably 4 to 11 mol %. In the case where the modified PVA of the present invention contains an additional hydrophilic group such as an ionic group, the content of ethylene units is preferably 5 to 15 mol %, more preferably 6 to 14.5 mol %. If the content of ethylene units is less than 3 mol %, the coated paper is poor in water resistance. If the content of ethylene units is more than 15 mol %, the modified PVA has a low solubility in boiling water and the coated paper is poor in water resistance.

The viscosity-average degree of polymerization (hereinafter referred to as "degree of polymerization") of the modified PVA is preferably 50 to 8000, more preferably 100 to 6000, and most preferably 200 to 4000. The degree of polymerization (P) is determined according to JIS K-6726. In other words, it is calculated by the formula below from the intrinsic viscosity measured in water at 30° C. after rehydrolysis and purification.

$$P=([\eta]\times10^3/8.29)^{(1/0.62)}$$

If the degree of polymerization is less than 50, the coated paper is poor in surface strength. If the degree of polymerization is more than 8000, the coating agent gives an aqueous solution which is too viscous to be applied easily.

The degree of hydrolysis of the modified PVA is preferably 80 to 99.99 mol %, more preferably 85 to 99.9 mol %, more preferably 88 to 99.8 mol %, and most preferably 97 to 99.8 mol %. If the degree of hydrolysis is less than 80 mol %, the modified PVA has a low solubility in boiling water and the coated paper is poor in water resistance. If the degree of hydrolysis is more than 99.99 mol %, the coating agent is poor in applicability or an aqueous solution of the coating agent is poor in viscosity stability.

The modified PVA in the present invention can be obtained by hydrolysis of a copolymer of a vinyl ester and ethylene. Examples of the vinyl ester include vinyl formate, vinyl acetate, vinyl propionate, vinyl valerate, vinyl laurate, vinyl stearate, vinyl benzoate, vinyl pivalate, and vinyl versatate. Among these examples, vinyl acetate is most preferable.

Moreover, the modified PVA in the present invention can optionally contain an anionic group or a cationic group. Examples of a monomer having an anionic group or a cationic group are exemplified as follows. Monomers having a carboxyl group derived from fumaric acid, maleic acid, itaconic acid, maleic anhydride, phthalic anhydride, trimellitic anhydride, or itaconic anhydride. Monomers having a sulfonic group derived from ethylenesulfonic acid, allylsulfonic acid, methallylsulfonic acid, or 2-acrylamide-2-methylpropanesulfonic acid. Monomers having a cationic group derived from vinyloxyethyl trimethylammonium chloride, vinyloxybutyl trimethylammonium chloride, vinyloxyethyl dimethylamine, vinyloxymethyl diethylamine, N-acrylamidemethyl trimethylammonium chloride, N-acrylamideethyl trimethylammonium chloride, N-acrylamidedimethylamine, allyltrimethylammonium chloride, methacryl trimethylammonium chloride, dimethylallylamine, or allylethylamine.

Among these monomers, the following are preferable because of their availability and copolymerizability. Maleic anhydride, half-ester of maleic anhydride, itaconic acid, allylsulfonic acid, 2-acrylamide-2-methylpropanesulfonic acid, N-acrylamide methyltrimethylammonium chloride, and N-acrylamide ethyltrimethylammonium chloride. The content of these monomer units is usually 10 mol % or less, preferably 0.1 to 8 mol %.

The modified PVA in the present invention can contain any other monomer units than vinyl alcohol units and vinyl ester units in an amount not to impair the effect of the present invention. Examples of such monomers include the following.

Acrylic acid and salts thereof.

Acrylic esters such as methyl acrylate, ethyl acrylate, n-propyl acrylate, and i-propyl acrylate.

Methacrylic acid and salts thereof.

Methacrylic esters such as methyl methacrylate, ethyl methacrylate, n-propyl methacrylate, and i-propyl methacrylate.

Acrylamide.

Acrylamide derivatives such as N-methylacrylamide and N-ethylacrylamide.

Methacrylamide.

Methacrylamide derivatives such as N-methylmethacrylamide and N-ethylmethacrylamide.

Vinyl ether such as methyl vinyl ether, ethyl vinyl ether, n-propyl vinyl ether, and i-propyl vinyl ether.

Nitriles such as acrylonitrile and methacrylonitrile.

Halogenated vinyl such as vinyl chloride, vinylidene chloride, vinyl fluoride, and vinylidene fluoride.

Allyl compounds such as allyl acetate and allyl chloride.

Maleic acid, salts thereof, and esters thereof.

Itaconic acid, salts thereof, and esters thereof.

Vinylsilyl compound such as vinyltrimethylsilane.

Isopropenyl acetate.

The content of these monomer units is preferably 10 mol % or less, more preferably 5 mol % or less, and more preferably 3 mol % or less.

In the paper coating agent of the present invention, the amount of an alkali metal ion (B) based on 100 parts by weight of a modified PVA (A) is 0.003 to 1 part by weight, preferably 0.005 to 0.8 part by weight, more preferably 0.007 to 0.6 parts by weight, and most preferably 0.02 to 0.5 part by weight. Examples of the alkali metal ions include a potassium ion and a sodium ion. If the ratio of the alkali metal ion is less than 0.003 part by weight, the modified PVA has a low solubility in boiling water. If the ratio of the alkali metal ion is more than 1 part by weight, the paper coating agent discolors the coated paper at the time of drying after its application.

The modified PVA (A) can be incorporated with the alkali metal ion (B) in any manner. A preferred process comprises hydrolyzing a copolymer of a vinyl ester and ethylene in a solvent by the use of an alkaline substance containing an alkali metal ion as a catalyst, thereby introducing the alkali metal ion into the modified PVA. Subsequently, the modified PVA is washed to remove an excess alkali metal ion which is contained in the modified PVA.

Examples of the alkaline substance as a catalyst for hydrolysis include potassium hydroxide and sodium hydroxide. The amount of the alkaline substance to be used as a catalyst for hydrolysis is preferably 0.004 to 0.5 mol, most preferably 0.005 to 0.3 mol, based on 1 mol of the vinyl acetate unit. The catalyst for hydrolysis can be added all at once at the initial stage of hydrolysis; or, it can be added in portions in the course of hydrolysis.

The hydrolysis can be carried out in a solvent such as methanol, methyl acetate, dimethylsulfoxide, and dimethylformamide. Among these solvents, methanol is preferable, methanol of which the water content is controlled is more preferable. The water content in methanol is preferably 0.001 to 1 wt %, most preferably 0.005 to 0.8 wt %.

Examples of the washing liquid include methanol, acetone, hexane, and water. Among these washing liquids, methanol is preferable. The amount of the washing liquid is controlled so that the ratio of the alkali metal ion (B) can fall into the aforementioned range, but preferable 300 to 10,000 parts by weight, more preferably 500 to 5,000 parts by weight, based on 100 parts by weight of the modified PVA.

Washing is carried out preferably at 5° to 80° C., more preferably 20° to 70° C., and is preferably for 20 minutes to 10 hours, more preferably 1 to 6 hours.

The modified PVA in the present invention has a degree of swelling in water at 20° C., which is preferably 1.2 to 4, more preferably 1.2 to 3, and most preferably 1.2 to 2.3. The degree of swelling specified above is favorable for the modified PVA to dissolve in boiling water readily and completely, so that the aqueous solution of paper coating agent does not have insoluble matter and can give coated paper having good surface properties such as water resistance. The degree of swelling of the modified PVA is calculated from the formula below.

$$\text{Degree of swelling}=A/B$$

where A is the weight of wet modified PVA measured after immersion of the sample of the modified PVA with a granular size of 16 mesh-pass to 32 mesh-on into a large amount of water at 20° C. for 2 hours and centrifugal hydro-extraction at 3000 rpm for 3 minutes, and B is the weight of fully dried modified PVA measured before immersion.

After hydrolysis and washing, the modified PVA is dried preferably at 60° to 120° C., more preferably 70° to 110° C., and is preferably for 30 minutes to 10 hours, more preferably 1 to 5 hours. These drying conditions are favorable for the modified PVA to have a degree of swelling as mentioned above and contain a small amount of volatile matter (organic solvent) originating from the washing liquid.

The paper coating agent of the present invention can be prepared from the modified PVA containing the alkali metal ion by dissolution in boiling water. The concentration of the modified PVA in the paper coating agent of the present invention is preferably in the range of 0.1 to 30 wt %, so that the aqueous solution of the coating agent is easy to apply.

The paper coating agent of the present invention can be incorporated with optional additives as required. Examples of such additives include water-resistant agents (such as glyoxal, urea resin, melamine resin, polyvalent metal salts, and water-soluble polyamide resin), plasticizers (such as glycol and glycerin), pH adjusting agents (such as ammonia, sodium hydroxide, sodium carbonate, and phosphoric acid), antifoaming agent, mold release agent, and surface active agent.

In addition, the paper coating agent of the present invention can be used in combination with a water-soluble polymer and an aqueous emulsion (hereinafter collectively referred to as "aqueous polymer") in an amount not to impair the effect of the present invention.

Examples of the water-soluble polymer in the aqueous polymer include the following.

Unmodified PVA.

Modified PVA such as carboxyl-modified PVA, sulfonic acid-modified PVA, acrylamide-modified PVA, cation-modified PVA, and long chain alkyl-modified PVA.

Starch and derivatives thereof.

Cellulose derivatives such as hydroxymethylcellulose, hydroxyethylcellulose, carboxymethylcellulose, methylcellulose, and ethylcellulose.

Sodium polyacrylate, polyvinylpyrrolidone, acrylamide-acrylate copolymer, acrylamide-acrylate-methacrylic acid terpolymer, alkali salt of styrene-maleic anhydride copolymer, alkali salt of isobutylene-maleic anhydride copolymer, polyacrylamide, sodium alginate, gelatin, and casein.

Examples of the aqueous emulsion in the aqueous polymer include the following.

Emulsions of polyvinyl acetate, polyurethane, polyacrylic acid, polyacrylate ester, vinyl chloride-vinyl acetate copolymer, polybutyl methacrylate, and ethylene-vinyl acetate copolymer.

Latexes of styrene-butadiene copolymer and styrene-butadieneacrylic copolymer.

The paper coating agent of the present invention is not specifically restricted in coating weight. A usual coating weight is about 0.1 to 30 g/m$^2$ (in terms of solids).

The paper coating agent of the present invention can be applied to any paper, including paper board (such as manila board, white board, and liner) and printing paper (such as wood-free paper, low-grade wood-free paper, and gravure paper).

The paper coating agent of the present invention can be applied to paper by using any coating machine, including size press coater, air-knife coater, blade coater, and roll coater.

After application, the coated paper is dried and then finished by supercalendering.

The paper coating agent of the present invention can be incorporated with a pigment, such as clay, kaolin, talc, calcined clay, satin white, calcium carbonate, titanium oxide, diatomaceous earth, silica, aluminum oxide, synthetic aluminum silicate, synthetic magnesium silicate, polystyrene fine particles, polyvinyl acetate fine particles, and urea-formalin resin fine particles.

These pigments can be used in combination with a dispersing agent, such as sodium pyrophosphate, sodium hexametaphosphate, and sodium polyacrylate.

In the case where the paper coating agent is used as a pigmented coating agent, the amount of the modified PVA is preferably 0.5 to 15 parts by weight, more preferably 1 to 10 parts by weight, based on 100 parts by weight of the pigment. The content of solids in the coating solution is preferably in the range of 30 to 65 wt %.

When dissolved in boiling water to prepare a coating solution, there is not insoluble matter of the modified PVA in the paper coating agent of the present invention on account of its high solubility in boiling water.

When applied to paper, the paper coating agent of the present invention can give coated paper which is free from discoloration and is superior in surface strength, air barrier properties, and printability. The same is true in the case of the pigmented coating agent of the present invention.

Next, the heat-sensitive recording material of the second invention is described in the following.

The coating layer of the second invention comprises the modified PVA (A) used in the first invention. The coating layer of the second invention comprises preferably the paper coating agent of the first invention.

Embodiments of the coating layer of the second invention are at least one layer selected from a heat-sensitive color developing layer (1), a surface protective layer (2) on said layer (1), and an undercoating layer between said layer (1) and the substrate.

The heat-sensitive color developing layer (1) comprises a heat-sensitive dye, a color developing agent, and a binder.

The heat-sensitive dye is not specifically restricted so long as it is selected from those which are commonly used for pressure-sensitive paper or heat-sensitive paper. It is exemplified below.

Triarylmethane compounds, such as 3,3-bis(p-dimethylaminophenol)-6-dimethylaminophthalide (crystal-violet-lactone), 3-(p-dimethylaminophenyl)-3-(1,2-dimethylindol-3-yl)-phthalide, 3-(p-dimethylaminophenyl)-3-(2-phenylindol-3-yl)phthalide, and 3,3-bis-(9-ethylcarbazol-3-yl)-5-dimethylaminophthalide.

Diphenylmethane compounds, such as 4,4'-bisdimethylaminobenzhydrin benzyl ether and N-halophenyl leuco auramine.

Xanthene compounds, such as rhodamine B-anilinolactam, 3-diethylamino-7-benzylaminofluorane, 3-diethylamino-7-butylamoniofluorane, 3-diethylamino-7-(chloroanilino)-fluorane, 3-diethylamino-6-methyl-7-anilinofluorane, 3-piperidino-6-methyl-7-anilinofluorane, 3-ethyl-tolylamino-6-methyl-7-anilinofluorane, 3-cyclohexyl-methylamino-6-methyl-7-anilinofluorane, 3-diethylamino-6-chloro-7-(β-ethoxyethyl) aminofluorane, 3-diethylamino-6-chloro- 7-(γ-chloropropyl)aminofluorane, 3-(N-ethyl-N-isoamyl)-6-methyl-7-phenylaminofluorane, and 3-dibutylamino-6-methyl-7-anilinofluorane.

Thiazine compounds, such as benzoyl leuco methylene blue and p-nitrobenzoyl leuco methylene blue.

Spiro compounds, such as 3-methyl-spiro-dinaphthopyran, 3-ethyl-spiro-dinaphthopyran, 3-benzylspiro-dinaphthopyran, and 3-methylnaphtho-(3-methoxy-benzo)-spiropyran.

These heat-sensitive dyes can be used alone or in combination of two or more.

The color developing agent used in the present invention preferably includes phenol derivatives and aromatic carboxylic acid derivatives. Among these derivatives, bisphenols are particularly preferable.

Examples of phenol derivatives include p-octylphenol, p-tert-butylphenol, p-phenylphenyl, 1,1-bis(p-hydroxyphenyl)propane, 2,2-bis(p-hydroxyphenyl)propane, 1,1-bis(p-hydroxyphenyl)pentane,1,1-bis(p-hydroxyphenyl) hexane, 2,2-bis(p-hydroxyphenyl)hexane, 1,1-bis(p-hydroxyphenyl)-2-ethyl-hexane, 2,2-bis(4-hydroxy-3,5-dichlorophenyl)propane, and dihydroxydiphenyl ether.

Examples of aromatic carboxylic acid derivatives include p-hydroxybenzoic acid, ethyl p-hydroxybenzoate, butyl p-hydroxybenzoate, 3,5-di-tert-butylsalicylic acid, 3,5-di-α-methylbenzylsalicylic acid, and polyvalent metal salts thereof.

The binder used for the heat-sensitive color developing layer is preferably the modified PVA as defined in the present invention, from the standpoint of water resistance, color development, and film strength. The amount of the binder is 1 to 20 parts by weight based on 100 parts by weight of the total amount of the heat-sensitive dye and color developing agent.

Other examples of the binder include "aqueous polymers" explained in the first invention.

The heat-sensitive dye and color developing agent can optionally be incorporated with a variety of additives such as filler, surface active agent, heat-fusible substance (or slip agent), antifoaming agent, dispersing agent, humectant, and inhibitor against color development under pressure, for the purpose of their improvement in applicability of the coating agent, whiteness, and color development sensitivity.

The surface protective layer (2) is preferably applied on the heat-sensitive color developing layer (1). The surface protective layer comprises preferably the modified PVA as defined in the present invention, from the standpoint of water resistance, plasticizer resistance, oil resistance, and organic solvent resistance. The surface protective layer may also be applied from "aqueous polymers" explained in the first invention.

The surface protective layer can optionally be incorporated with a filler and slip agent.

Examples of the filler include those explained in the first invention.

Examples of the slip agent include higher fatty acid, higher fatty acid amide, higher fatty acid metal salt, paraffin wax, and microcrystalline wax.

The amount of the water-soluble polymer in the surface protective layer is preferably 15 or more wt % of all the components. If the amount of the water-soluble polymer is less than 15 wt %, the surface protective layer is poor in water resistance, oil resistance, and plasticizer resistance.

The amount of solids in the surface protective layer is determined not to impair smooth heat conduction from the thermal head to the heat-sensitive color developing layer, and is usually 1 to 10 g/m$^2$, preferably 2 to 7 g/m$^2$.

The surface-protective layer can be of multi-layer structure or can be provided with a backing layer.

The undercoating layer (3) is preferably applied between the substrate and the heat-sensitive color developing layer (1). The undercoating layer comprises preferably the modified PVA as defined in the present invention, from the standpoint of heat resistance, water resistance, plasticizer resistance, oil resistance, and organic solvent resistance. It may also be applied from "aqueous polymers" explained in the first invention.

The undercoating layer can optionally be incorporated with a filler and slip agent, such as those listed in the description of the surface protective layer.

The substrate can be paper, synthetic fiber paper, or plastic film.

The modified PVA in the present invention is suitable for the binder of the heat-sensitive color developing layer, surface-protective layer, and undercoating layer. Therefore, the heat-sensitive recording material of the present invention is superior in color development sensitivity, water resistance, oil resistance, plasticizer resistance, and polyvinyl chloride (hereinafter referred to as "PVC") film resistance.

In addition, the heat-sensitive recording material of the present invention is superior in high-speed printability and image resolution. Therefore, it can find use in the field, such as facsimile, where high-speed printing is required.

EXAMPLES

The invention is described in more detail with reference to the following examples, in which "parts" and "%" are based on weight, unless otherwise indicated.

(1) Aqueous Solution of Coating Agent

The physical properties of the aqueous solution of the coating agent were evaluated in the following manner.

Insoluble matter

A sample of the modified PVA powder (16 mesh-pass to 32 mesh-on) was stirred in water at 90° C. for 1 hour, and the solution was visually observed on insoluble matter.

Viscosity

The viscosity of the aqueous solution was measured at 30° C. by using a Brookfield viscometer with a rotation at 60 rpm.

(2) Physical Properties of Coated Paper

The physical properties of the coated paper were evaluated in the following manner.

Wet rub method 0.1 ml of deionized water (at 20° C.) was dropped on the surface of a specimen of the coated paper and then rubbed with a finger tip. Change in the coating agent was observed. The results were rated as follows on a scale of one to five.

5: no slimy feel owing to excellent water resistance.

4: no change in coating layer but slimy feel.

3: coating agent is partly emulsified.

2: coating agent is entirely re-emulsified.

1: coating agent is dissolved.

Wet picking method

The coated surface was wetted with water (at 20° C.) and observed on picking by using an RI machine (made by Akira Seisakusho). The results were rated as follows on a scale of one to five.

5: no picking.

4: very slight picking

3: appreciable picking

2: picking on almost the entire surface

1: picking on the entire surface

Printability

Snap dry ink (from Dainippon Ink & Chemicals, Inc.) was applied on the coated paper to form 5-μm thick coating by using RI printability testing machine. Ink receptivity and print gloss were observed, and the results were rated as follows.

excellent: uniform, dark printing, with a distinct boundary between the printed part and unprinted part.

good: slightly non-uniform, slightly less dark printing, with a slightly blurred boundary between the printed part and unprinted part.

poor: appreciably non-uniform, faint, blurred printing, with a blurred boundary between the printed part and unprinted part.

Surface strength

The surface strength was tested by using an IGT printability testing machine and IGT pick oil M (from Dainippon Ink & Chemicals, Inc.), at a printing pressure of 35 kg/cm with the spring drive B. The greater the value, the higher the surface strength.

Air permeability

Measured by using an air permeability testing machine of Ouken type. The greater the value, the better the barrier properties.

(3) Physical Properties of Heat-sensitive Recording Paper

The physical properties of the heat-sensitive recording paper were evaluated in the following manner.

Color density of printed and unprinted parts on the heat-sensitive recording paper.

A sample of the heat-sensitive paper was printed by using a heat-sensitive facsimile printer ("Rifax 300" made by Ricoh Co., Ltd.), and the printed and unprinted parts were measured for color density by using a Macbeth densitometer (RD-514, made by Macbeth Co., Ltd.).

Incidentally, the Macbeth density of 0.00 means complete white and 1.82 means complete black.

Water resistance

After printing, a sample of the heat-sensitive recording paper was immersed in water at 20° C. for 24 hours, and the wet surface was rubbed with a finger tip. Change in the surface protective layer was visually observed. Also, the color density of the printed parts was visually observed. The results were rated as follows on a scale of one to five.

5: The surface protective layer did not dissolve. No decrease in the color density of printed parts.

4: About 10% of the surface protective layer dis-solved. Slight decrease in the color density of printed parts.

3: About 20 to 40% of the surface protective layer dissolved. Appreciable decrease in the color density of printed parts. Printing was legible.

2: About 50 to 80% of the surface protective layer dissolved. Appreciable decrease in the color density of printed parts. Printing was illegible.

1: The surface protective layer dissolved completely. Printed parts substantially disappeared.

PVC film resistance

After printing, a sample of the heat-sensitive recording paper was laid between two sheets of soft PVC film, and they were allowed to stand at 20° C. for 24 hours under a load of 300 g/m$^2$. The color density of the printed parts was measured by using a Macbeth densitometer (mentioned above).

Oil resistance

After printing, a sample of the heat-sensitive recording paper was coated with cotton seed oil and allowed to stand at 20° C. and 40° C., respectively, for 24 hours. Change in the color density of the printed parts was visually observed. The results were rated as follows on a scale of one to five.

5: No decrease in the color density of the printed parts.

4: Slight decrease in the color density of the printed parts.

3: Great decrease in the color density of the printed parts. Printing was legible.

2: Great decrease in the color density of the printed parts. Printing was illegible.

1: Printed parts substantially disappeared.

Sticking resistance

During printing with the above-mentioned facsimile printer, visual observations were made on sticking. The results were rated as follows on a scale of one to five.

5: No sticking occurred.

4: Slight sticking occurred.

3: Sticking occurred, but printing was legible.

2: Appreciable sticking occurred, and printing was illegible.

1: Severe sticking occurred, and printing was impossible to carry out.

Durability of head

A continuous running test was carried out by using a label printer equipped with a thin-film head. The result is expresed in terms of the length until a defect occurred.

Variation in printing temperature

Using a heat inclination meter with a built-in thermal head, printing was carried out under the condition that the pressure was 2 kg/cm$^2$, the pressing time was 1 second, and the printing temperature was 100° C. and 130° C., respectively. The color density of the printed parts and unprinted parts was measured by using the above-mentioned Macbeth densitometer.

Example 1

A copolymer composed of 5 mol % of ethylene units and 95 mol % of vinyl acetate units was dissolved in methanol to give a solution with a solid concentration of 30% and a water concentration of 0.05%. The solution was mixed with sodium hydroxide in an amount of 0.05 mol per 1 mol of vinyl acetate units. Hydrolysis was carried out at 40° C. for 1 hour and then at 60° C. for 1 hour. 100 parts of the obtained polymer was washed with 2000 parts of methanol at 60° C. for 1 hour and finally separated from methanol. This washing step was repeated, and the polymer was dried at 100° C. for 3 hours. Thus there was obtained water-soluble modified PVA which is characterized as follows.

The content of ethylene units is 5 mol %. The degree of hydrolysis of vinyl acetate units is 99.0 mol %. The degree of polymerization is 1200. The content of sodium ions (determined by atomic absorption spectrometry) is 0.2 part based on 100 parts of the modified PVA.

An aqueous dispersion of kaolin clay was prepared with vigorous stirring by adding 100 parts of kaolin clay to 82.5 parts of aqueous solution containing 0.3 part of sodium polyacrylate. 182.5 parts of the aqueous dispersion was mixed into 25 parts of 20% aqueous solution of the modified PVA mentioned above. Thus there was obtained an aqueous solution of coating agent with a solid concentration of 45% and a viscosity of 600 mPa-s at 30° C.

The aqueous solution of coating agent was applied to wood-free paper (having a basis weight of 60 g/m$^2$) by using a laboratory flexible blade coater. The coating weight was 15 g/m$^2$ as solids. After drying at 105° C. for 2 minutes, the coated paper was finished by calendering at a surface temperature of 85° C. and under a linear pressure of 100 kg/cm. The obtained coated paper was tested for physical properties after conditioning at 20° C. and 65%RH for 72 hours. The results are shown on Table 2.

Examples 2 to 7

The same procedure as in Example 1 was repeated except that the modified PVA was replaced by the one shown on Table 1. The results are shown on Table 2.

Comparative Examples 1 to 3

The same procedure as in Example 1 was repeated except that the modified PVA was replaced by the modified PVA or unmodified PVA shown on Table 1. The results are shown on Table 2.

Comparative Examples 4 and 5

The same procedure as in Example 1 was repeated except that the modified PVA was replaced by the modified PVA shown on Table 1 which was prepared in the following manner. The results are shown on Table 2.

Modified PVA in Comparative Example 4 is the same one as used in Example 3, except that it underwent methanol washing four times in the same manner as in Example 1.

Modified PVA in Comparative Example 5 is the same one as used in Example 3, except that it did not undergo methanol washing.

TABLE 1

| | Modif s (B)ied PVA(A) | | | | | | |
|---|---|---|---|---|---|---|---|
| | Content of ethylene units (mol %) | Comonomer | Content of comonomer (mol %) | Degree of hydrolysis (mol %) | Degree of polymerization | Degree of swelling | Alkali metal ion (B) $Na^+$ content (parts/100 parts PVA) |
| Example 1 | 5 | — | 0 | 99.0 | 1200 | 1.9 | 0.2 |
| Example 2 | 10 | — | 0 | 99.1 | 1200 | 1.5 | 0.2 |
| Example 3 | 10 | — | 0 | 99.1 | 1200 | 1.4 | 0.005 |
| Example 4 | 14 | MAPTAC[1)] | 0.5 | 98.9 | 600 | 1.4 | 0.4 |
| Example 5 | 10 | IA[2)] | 0.5 | 99.3 | 1200 | 1.5 | 0.6 |
| Example 6 | 4 | — | 0 | 99.5 | 1800 | 2.0 | 0.4 |
| Example 7 | 11 | — | 0 | 96.4 | 500 | 2.5 | 0.2 |
| Comparative Example 1 | 0 | — | 0 | 99.0 | 1200 | 4.3 | 0.2 |
| Comparative Example 2 | 2 | — | 0 | 99.0 | 1200 | 4.1 | 0.2 |
| Comparative Example 3 | 16 | — | 0 | 98.9 | 600 | 1.3 | 0.2 |
| Comparative Example 4 | 10 | — | 0 | 99.1 | 1200 | 1.4 | 0.002 |
| Comparative Example 5 | 10 | — | 0 | 99.1 | 1200 | 1.6 | 1.5 |

[1)]MAPTAC 3-methacrylamidepropyltrimethylammonium chloride
[2)]IA: itaconic acid

TABLE 2

| | Aqueous solution of coating agent | | Coated paper | | | | |
|---|---|---|---|---|---|---|---|
| | | | | Water resistance strength | | | |
| | Insoluble matter | Viscosity (mPa · s) | Coating weight (g/m$^2$) | Wet rub method | Wet pick method | Printability | Discoloration |
| Example 1 | none | 600 | 15.0 | 5 | 5 | excellent | none |
| Example 2 | none | 750 | 15.1 | 5 | 5 | excellent | none |
| Example 3 | none | 920 | 15.1 | 4 | 4 | excellent | none |
| Example 4 | none | 410 | 15.0 | 5 | 5 | excellent | none |
| Example 5 | none | 800 | 15.0 | 4 | 4 | excellent | none |
| Example 6 | none | 1100 | 15.0 | 5 | 5 | excellent | none |
| Example 7 | none | 380 | 15.0 | 4 | 4 | excellent | none |
| Comparative Example 1 | none | 550 | 15.1 | 1 | 1 | good | none |
| Comparative Example 2 | none | 570 | 15.0 | 2 | 2 | good | none |
| Comparative Example 3 | entirely insoluble | — | — | — | — | — | — |
| Comparative Example 4 | partly insoluble | — | 15.4 | 3[1)] | 3[1)] | poor | none |
| Comparative Example 5 | none | 640 | 15.0 | 3 | 3 | excellent | brown |

[1)]The coated layer was not uniform due to insoluble matter.

Example 8

A 4.5% aqueous solution of coating agent was prepared by dissolving 4.5 parts of the modified PVA used in Example 1 into 95.5 parts of water with heating. The aqueous solution was applied at 50° C. to wood-free paper (with a basis weight of 64 g/m$^2$) by using a laboratory size press (made by Kumagai Riki Kogyo Co., Ltd.), with the nip pressure being 18 kg/cm and the coating speed being 60 m/min. The coating weight was 1.0 g/m$^2$ in terms of solids. The coated paper was tested for physical properties after conditioning at 20° C. and 65%RH for 72 hours. The results are shown on Table 4.

Examples 9 to 13

The same procedure as in Example 8 was repeated, except that the modified PVA was replaced by the one shown on Table 3. The results are shown on Table 4.

Comparative Examples 6 to 10

The same procedure as in Example 8 was repeated, except that the modified PVA was replaced by the modified or unmodified PVA shown on Table 3. The results are shown on Table 4.

TABLE 3

| | Modified PVA(A) | | | | | | |
|---|---|---|---|---|---|---|---|
| | Content of ethylene units (mol %) | Comonomer | Content of comonomer (mol %) | Degree of hydrolysis (mol %) | Degree of polymerization | Degree of swelling | Alkali metal ion (B) $Na^+$ content (parts/100 parts PVA) |
| Example 8 | 5 | — | 0 | 99.0 | 1200 | 1.9 | 0.2 |
| Example 9 | 10 | — | 0 | 99.1 | 1200 | 1.5 | 0.2 |
| Example 10 | 10 | — | 0 | 99.1 | 1200 | 1.4 | 0.005 |
| Example 11 | 14 | MAPTAC[1)] | 0.5 | 98.9 | 600 | 1.4 | 0.4 |
| Example 12 | 4 | — | 0 | 99.5 | 1800 | 2.0 | 0.4 |
| Example 13 | 11 | — | 0 | 96.4 | 500 | 2.5 | 0.2 |
| Comparative Example 6 | 0 | — | 0 | 99.0 | 1200 | 4.3 | 0.2 |
| Comparative Example 7 | 2 | — | 0 | 99.0 | 1200 | 4.1 | 0.2 |
| Comparative Example 8 | 16 | — | 0 | 98.9 | 600 | 1.3 | 0.2 |
| Comparative Example 9 | 10 | — | 0 | 99.1 | 1200 | 1.4 | 0.002 |
| Comparative Example 10 | 10 | — | 0 | 99.1 | 1200 | 1.6 | 1.5 |

[1)]MAPTAC 3-methacrylamidepropyltrimethylammonium chloride

TABLE 4

| | Aqueous solution of coating agent | | | Coated paper | | | |
|---|---|---|---|---|---|---|---|
| | Insoluble matter | Viscosity (mPa · s) | Coating weight (g/m$^2$) | Surface strength (cm/sec) | Air permeability (sec) | Printability | Discoloration |
| Example 8 | none | 8.0 | 1.0 | 180 | 1350 | excellent | none |
| Example 9 | none | 9.5 | 1.0 | 195 | 1700 | excellent | none |
| Example 10 | none | 9.0 | 1.0 | 195 | 1200 | excellent | none |
| Example 11 | none | 6.8 | 1.0 | 185 | 980 | excellent | none |
| Example 12 | none | 18.5 | 1.0 | 220 | 3200 | excellent | none |
| Example 13 | none | 6.5 | 1.0 | 150 | 900 | excellent | none |
| Comparative Example 6 | none | 7.5 | 1.0 | 110 | 350 | good | none |
| Comparative Example 7 | none | 9.1 | 1.0 | 120 | 640 | good | none |
| Comparative Example 8 | entirely insoluble | — | — | — | — | — | — |
| Comparative Example 9 | partly insoluble | — | 1.2 | 85[1)] | 60[1)] | poor | none |
| Comparative Example 10 | none | 9.6 | 1.0 | 130 | 1000 | excellent | brown |

[1)]The coated layer was not uniform due to insoluble matter.

Example 14

| (1) Preparation of coating liquid | |
|---|---|
| A. Aqueous dispersion of heat-sensitive dye | |
| Leuco dye ("S-205" from Yamada Kagaku) | 20% |
| 10% aq. solution of sulfonic acid-modified PVA* | 20% |
| Water | 59.9% |
| Antifoaming agent ("Surfinol 440", from Nisshin Kagaku Kogyo Co., Ltd.) | 0.1% |
| *modified by copolymerization with 2 mol % of allylsulfonic acid. degree of polymerization = 200, degree of hydrolysis = 87 mol % | |
| B. Aqueous dispersion of color developing agent | |
| Bisphenol A | 20% |
| 10% aq. solution of sulfonic acid-modified PVA* | 20% |
| Water | 59.9% |
| Antifoaming agent ("Surfinol 440", from Nisshin Kagaku Kogyo Co., Ltd.) | 0.1% |
| *the same one as used in A. | |
| C. Aqueous dispersion of pigment | |
| Stearlamide | 10% |
| Calcium carbonate | 20% |
| 5% aq. solution of sulfonic acid-modified PVA* | 30% |
| Water | 40% |
| *the same one as used in A. | |

The above-mentioned three aqueous dispersions (A, B, and C) were prepared separately and preliminarily stirred in a beaker for 15 minutes. Each of the aqueous dispersions A and B was transferred to a sand grinder (a batch-type desk-top sand grinder, made by Kansai Paint Co., Ltd.). Each was stirred with cooling to obtain a thorough dispersion at a high speed (2170 rpm) together with glass beads (soda-quartz glass, 0.5 mm in diameter) for 6 hours. The aqueous dispersion C was stirred for 2 minutes to obtain a thorough dispersion by using a homogenizer (10000 rpm).

(2) Production of Heat-sensitive Recording Paper

A coating solution for the heat-sensitive color developing layer was prepared by mixing from 1 part of the aqueous dispersion A, 4 parts of the aqueous dispersion B, 2 parts of the aqueous dispersion C, and 2 parts of a 10% aqueous solution of modified PVA (containing 7 mol % of ethylene units, with a degree of polymerization being 1050 and a degree of hydrolysis being 98.5 mol %). The obtained coating liquid was applied to wood-free paper (with a basis weight of 52 g/m$^2$) by using a wire bar coater. The coating weight was 6 g/m$^2$ (in terms of solids). After drying at 50° C. for 10 minutes, the coated paper underwent supercalendering at a linear pressure of 30 kg/cm for surface treatment. Thus there was obtained a sample of heat-sensitive recording paper.

The content of alkali metal ion in the modified PVA was determined by atomic absorption spectrometry. The obtained heat-sensitive recording paper was tested for physical properties after conditioning at 20° C. and 65%RH for 72 hours. The results are shown on Table 6.

Examples 15 and 16

The same procedure as in Example 14 was repeated, except that the modified PVA was replaced by the one shown on Table 5. The results are shown on Table 6.

Comparative Example 11

The same procedure as in Example 14 was repeated, except that the modified PVA was replaced by the unmodified PVA shown on Table 5. The results are shown on Table 6.

TABLE 5

| | Modified PVA(A) | | | | | | |
|---|---|---|---|---|---|---|---|
| | Content of ethylene units (mol %) | Comonomer | Content of comonomer (mol %) | Degree of hydrolysis (mol %) | Degree of polymerization | Degree of swelling | Alkali metal ion (B) $Na^+$ content (parts/100 parts PVA) |
| Example 14 | 7 | — | 0 | 98.5 | 1050 | 1.7 | 0.15 |
| Example 15 | 4 | — | 0 | 95.5 | 1700 | 2.9 | 0.29 |
| Example 16 | 12 | — | 0 | 99.4 | 500 | 1.4 | 0.27 |
| Comparative Example 11 | 0 | — | 0 | 98.5 | 1000 | 4.1 | 0.49 |

TABLE 6

| | Heat-sensitive recording paper Color density | |
|---|---|---|
| | Printed parts | Unprinted parts |
| Example 14 | 1.38 | 0.07 |
| Example 15 | 1.37 | 0.07 |
| Example 16 | 1.38 | 0.07 |
| Comparative Example 11 | 1.22 | 0.12 |

Example 17

A coating liquid for the heat-sensitive color developing layer was prepared by mixing from 1 part of the aqueous dispersion A, 6 parts of the aqueous dispersion B, and 2 parts of a 10% aqueous solution of unmodified PVA (having a degree of polymerization of 1750 and a degree of hydrolysis of 98.5 mol %). The obtained coating liquid was applied to wood-free paper (with a basis weight of 52 g/m$^2$) by using a wire bar coater. The coating weight was 6 g/m$^2$ (in terms of solids). After drying at 50° C. for 10 minutes, the coated paper underwent supercalendering at a linear pressure of 30 kg/cm for surface treatment. The thus formed heat-sensitive color developing layer was coated with an aqueous dispersion D specified below to form a surface protective layer.

The coating weight was 3 g/m$^2$ on dry basis. Thus there was obtained a sample of heat-sensitive recording paper. It was tested for physical properties. The results are shown on Table 8.

| D. Aqueous dispersion for surface protective layer | |
|---|---|
| 60% dispersion of kaolin | 6% |
| 30% dispersion of zinc stearate | 4% |
| 10% aqueous solution of modified PVA* | 90% |

*containing 4 mol % of ethylene units, degree of polymerization = 1300, degree of hydrolysis = 99.0 mol %

Examples 18 to 21 and Comparative Examples 12 to 16

Heat-sensitive recording paper was prepared in the same manner as in Example 17, except that the aqueous dispersion D was replaced by the one prepared from the modified PVA or unmodified PVA shown on Table 7. The results are shown on Table 8.

TABLE 7

| | Modified PVA(A) | | | | | | |
|---|---|---|---|---|---|---|---|
| | Content of ethylene units (mol %) | Comonomer | Content of comonomer (mol %) | Degree of hydrolysis (mol %) | Degree of polymerization | Degree of swelling | Alkali metal ion (B) $Na^+$ content (parts/100 parts PVA) |
| Example 17 | 4 | — | 0 | 99.0 | 1300 | 2.0 | 0.15 |
| Example 18 | 7.5 | — | 0 | 98.4 | 1000 | 1.6 | 0.27 |
| Example 19 | 1.25 | — | 0 | 96.6 | 550 | 2.4 | 0.25 |
| Example 20 | 14.4 | AMPS[1)] | 0.6 | 98.9 | 390 | 1.5 | 0.46 |
| Example 21 | 9.0 | MAPTAC[2)] | 0.5 | 99.2 | 950 | 1.4 | 0.24 |
| Comparative Example 12 | 0 | — | 0 | 98.0 | 1300 | 5.3 | 0.43 |
| Comparative Example 13 | 0 | — | 0 | 98.5 | 510 | 4.4 | 0.69 |
| Comparative Example 14 | 0 | AAc[3)] | 10 | 98.0 | 1200 | >10 | 1.04 |
| Comparative Example 15 | 2.5 | — | 0 | 98.0 | 1700 | 4.1 | 0.26 |
| Comparative Example 16 | 16 | — | 0 | 99.4 | 300 | 1.3 | 0.21 |

[1)]AMPS: sodium 2-acrylamide-2-methylpropylsulfonate
[2)]MAPTAC 3-methacrylamidepropyltrimethylammonium chloride
[3)]AAc: allyl acetate

TABLE 8

| | Aq. solution of coating agent Insoluble matter | Heat-sensitive recording paper | | | | | | |
|---|---|---|---|---|---|---|---|---|
| | | Color density of printed parts | Water resistance | PVC film resistance | Oil resistance 20° C. | Oil resistance 40° C. | Sticking resistance | Durability of thermal head (km) |
| Example 17 | none | 1.26 | 5 | 1.34 | 5 | 4 | 4 | >10 |
| Example 18 | none | 1.27 | 5 | 1.33 | 5 | 5 | 5 | >10 |
| Example 19 | none | 1.26 | 4 | 1.25 | 4 | 4 | 4 | >10 |
| Example 20 | none | 1.26 | 5 | 1.24 | 4 | 4 | 4 | >10 |
| Example 21 | none | 1.26 | 5 | 1.36 | 5 | 5 | 5 | >10 |
| Comparative Example 12 | none | 1.27 | 2 | 0.96 | 3 | 2 | 3 | >10 |
| Comparative Example 13 | none | 1.26 | 2 | 0.99 | 3 | 3 | 2 | >10 |
| Comparative Example 14 | none | 1.27 | 1 | 1.06 | 4 | 3 | 3 | 5 |
| Comparative Example 15 | none | 1.27 | 3 | 1.19 | 4 | 3 | 3 | >10 |
| Comparative Example 16 | entirely insoluble | — | — | — | — | — | | >10 |

Example 22

The aqueous dispersion D prepared in Example 17 was applied to wood-free paper (having a basis weight of 52 g/m$^2$) by using a wire bar coater to form an undercoating layer. The coating weight was 2 g/m$^2$. After drying at 50° C. for 10 minutes, the coated paper underwent supercalendering (at a linear pressure of 30 kg/cm). The undercoating layer was coated with a coating solution prepared by mixing from 1 part of the aqueous dispersion A, 6 parts of the aqueous dispersion B, and 2 parts of 10% aqueous solution of polyvinyl alcohol (having a degree of polymerization of 1750 and a degree of hydrolysis of 98.5 mol %). In this way a heat-sensitive color developing layer was formed. This layer was coated with the aqueous dispersion D to form the surface protective layer. The coating weight was 3 g/m$^2$. The thus obtained heat-sensitive recording paper was tested for physical properties. The results are shown on Table 11.

Examples 23 to 25 and Comparative Examples 17 and 18

The same procedure as in Example 22 was repeated except that the aqueous dispersion D for the undercoating layer and surface protective layer was replaced by the one prepared from the modified PVA or unmodified PVA shown on Tables 9 and 10. The results are shown on Table 11.

TABLE 9

| | Modified PVA(A) for undercoating layer | | | | | | |
|---|---|---|---|---|---|---|---|
| | Content of ethylene units (mol %) | Comonomer | Content of comonomer (mol %) | Degree of hydrolysis (mol %) | Degree of polymerization | Degree of swelling | Alkali metal ion (B) $Na^+$ content (parts/100 parts PVA) |
| Example 22 | 4 | — | 0 | 99.0 | 1300 | — | 0.15 |
| Example 23 | 4 | — | 0 | 99.0 | 1300 | — | 0.15 |
| Example 24 | 12.2 | — | 0 | 96.6 | 550 | — | 0.25 |
| Example 25 | 12.2 | — | 0 | 96.6 | 550 | — | 0.25 |
| Comparative Example 17 | 0 | — | 0 | 99.0 | 1300 | — | 0.15 |
| Comparative Example 18 | 0 | — | 0 | 99.0 | 1300 | — | 0.15 |

TABLE 10

| | Modified PVA(A) for surface protective layer | | | | | | |
|---|---|---|---|---|---|---|---|
| | Content of ethylene units (mol %) | Comonomer | Content of comonomer (mol %) | Degree of hydrolysis (mol %) | Degree of polymerization | Degree of swelling | Alkali metal ion (B) $Na^+$ content (parts/100 parts PVA) |
| Example 22 | 4 | — | 0 | 99.0 | 1300 | — | 0.15 |
| Example 23 | 4 | — | 0 | 99.0 | 1300 | — | 0.15 |
| Example 24 | 4 | — | 0 | 99.0 | 1300 | — | 0.15 |
| Example 25 | 0 | — | 0 | 98.5 | 1300 | — | 0.49 |
| Comparative Example 17 | 0 | — | 0 | 98.5 | 1300 | — | 0.49 |
| Comparative Example 18 | 0 | — | 0 | 98.5 | 1300 | — | 0.49 |

TABLE 11

| | Heat-sensitive recording paper | | |
|---|---|---|---|
| | Printing temperature | Color density | |
| | (°C.) | Printed parts | Unprinted parts |
| Example 22 | 130 | 1.37 | 0.07 |
| Example 23 | 100 | 1.30 | 0.06 |
| Example 24 | 130 | 1.31 | 0.07 |
| Example 25 | 100 | 1.27 | 0.08 |
| Comparative Example 17 | 130 | 1.21 | 0.11 |
| Comparative Example 18 | 100 | 1.09 | 0.88 |

What is claimed is:

1. Paper coated which a composition comprising a water soluble vinyl alcohol copolymer (A) containing 3 to 15 mol % of ethylene units and an alkali metal ion (B), with the ratio of component (A) to component (B) being 100:0.003 to 100:1 in parts by weight.

2. The paper of claim 1, wherein the ratio of component (A) to component (B) is 100:0.005 to 100:0.8 in parts by weight.

3. The paper of claim 1, wherein said vinyl alcohol copolymer (A) contains 3 to 13 mol % of ethylene units.

4. The paper of claim 1, wherein said vinyl alcohol copolymer (A) contains 3.5 to 12 mol % of ethylene units.

5. The paper of claim 1, wherein said vinyl alcohol copolymer (A) contains 4 to 11 mol % of ethylene units.

6. The paper of claim 1, wherein said vinyl alcohol copolymer (A) contains 5 to 15 mol % of ethylene units.

7. The paper of claim 1, wherein said vinyl alcohol copolymer (A) contains 6 to 14.5 mol % of ethylene units.

8. The paper of claim 1, wherein the degree of polymerization of the vinyl alcohol copolymer is from 50 to 8,000.

9. The paper of claim 1, wherein the degree of polymerization of the vinyl alcohol copolymer is from 200 to 4,000.

10. The paper according to claim 1, when the vinyl alcohol copolymer has a degree of swelling in water at 20° C. of from 1.2–4.

11. The paper of claim 1, additionally coated with an undercoating layer.

12. The paper of claim 1, wherein said composition is an aqueous solution.

13. The paper as claimed in claim 1, wherein said vinyl alcohol copolymer is obtained by hydrolysis of a copolymer of a vinyl ester and ethylene.

14. The paper as claimed in claim 13, wherein said vinyl ester is selected from the group consisting of vinyl formate, vinyl acetate, vinyl propionate, vinyl valerate, vinyl laurate, vinyl stearate, vinyl benzoate, vinyl pivalate, and vinyl versatate.

15. The paper as claimed in claim 13, wherein said vinyl ester is vinyl acetate.

* * * * *

UNITED STATES PATENT AND TRADEMARK OFFICE

CERTIFICATE OF CORRECTION

PATENT NO. : 5,885,720

DATED : March 23, 1999

INVENTOR(S): Naoki FUJIWARA, et al.

It is certified that an error appears in the above-identified patent and that said Letters Patent is hereby corrected as shown below:

Column 19, line 46, delete "which" and insert --with--.

Signed and Sealed this

Seventeenth Day of April, 2001

*Attest:*

Nicholas P. Godici

NICHOLAS P. GODICI

*Attesting Officer*

*Acting Director of the United States Patent and Trademark Office*